United States Patent [19]
Hurst
[11] 4,076,637
[45] Feb. 28, 1978

[54] METAL DISPERSIONS AND METHOD FOR PRODUCING SAME

[75] Inventor: Gerald L. Hurst, Austin, Tex.
[73] Assignee: Tyler Corporation, Dallas, Tex.

[21] Appl. No.: 727,679
[22] Filed: Sep. 29, 1976
[51] Int. Cl.[2] ..... C10M 1/10; C10M 3/02; C10M 5/02; C10M 7/02
[52] U.S. Cl. ..... 252/26; 264/15; 75/.5 C
[58] Field of Search ..... 252/26, 25; 264/15

[56] References Cited

U.S. PATENT DOCUMENTS

| | | | |
|---|---|---|---|
| 2,700,623 | 1/1955 | Hall | 252/26 |
| 2,952,868 | 9/1960 | Rowan | 264/15 |
| 3,063,099 | 11/1962 | Turner et al. | 264/15 |
| 3,232,872 | 2/1966 | Kohn | 252/26 |
| 3,505,434 | 4/1970 | Battaerd | 265/15 |
| 3,532,623 | 10/1970 | Groszek | 252/26 |
| 3,619,430 | 11/1971 | Hiratsuka et al. | 252/26 |
| 3,894,957 | 7/1975 | Lundin et al. | 252/26 |
| 3,928,214 | 12/1975 | Naka et al. | 252/26 |
| 3,939,081 | 2/1976 | Dehart et al. | 252/26 |

FOREIGN PATENT DOCUMENTS

| | | | |
|---|---|---|---|
| 904,211 | 8/1962 | United Kingdom | 264/15 |

*Primary Examiner*—Delbert E. Gantz
*Assistant Examiner*—Irving Vaughn
*Attorney, Agent, or Firm*—Richards, Harris & Medlock

[57] ABSTRACT

A method for producing high density metal-containing lubricants and for comminuting metal into fine spherical particles is provided by heating a carrier fluid such as a lubricant, for example, and a metal until the metal becomes liquid, admixing the two components to form a homogeneous dispersion of metal globules in the carrier fluid, and then cooling the mixture. When a lubricant carrier fluid is used, the resulting high-density lubricant contains discrete, spherical metallic particles dispersed therein and higher density is achieved without any consequent loss of lubricating properties.

26 Claims, No Drawings

METAL DISPERSIONS AND METHOD FOR PRODUCING SAME

BACKGROUND OF THE INVENTION

In one aspect, this invention relates to a process for manufacturing a high-density metal-containing grease. In another aspect, this invention relates to metal-containing greases of a high density which are useful in the down-hole drilling operations of the oil industry, for example. In still another aspect, this invention relates to a method for preparing powdered metals.

The drilling of oil wells continues to be of major importance in todays petroleum industry in light of increased demands for petroleum products. Maintenance of drilling equipment, therefore, is one objective in the effort to keep exploration costs as low as possible. Down-hole turbine drills are one important type of equipment used in petroleum explorations. Proper lubrication of this and other types of drilling equipment is desirable if optimum equipment life is to be achieved.

Adequate lubrication of down-hole turbine drills and similar types of equipment has been a problem because of the environment in which these types of equipment must operate. At the depths and pressures under which these types of equipment operate, dense drilling mud is present. This dense mud envelopes the equipment and, because it is of a higher density than normal lubricants, floats the protecting lubricants away from the equipment. These drilling muds have thus created maintenance problems and rendered normal equipment lubricants inadequate. In order to provide protection to drilling equipment, it has thus become necessary to develop a lubricant which will not be subject to this "floating away" action of the dense drilling mud. One solution is to provide a lubricant which is of a higher density than the drilling muds thereby avoiding the floatation effect of the muds. These muds typically have a density of about 2.5 g/ml with individual particle densities as high as about 4.0 g/ml. Thus, in the case of down-hole drilling operations, lubricants with densities greater than about 2.5 g/ml are desirable.

Conventional high density greases are prepared by mixing metal powders into lubricant bases. These conventional metal powders are formed by comminuting operations such as ball milling, filing, or by reduction from ionic solutions. The shape of metal particles produced by these methods is irregular, and commonly, the particles are flake-like or jagged as opposed to spherical. Thus, preparation of conventional metal containing greases involves either the purchase of such metal powders, or the production of them by one of the above described methods, followed by the mixing of the metal powders into a lubricant base.

It is well known in the art that the addition of finely divided soft metals increases the wear resistance qualities of some lubricants. Previously, the two-step process described above had to be carried out to obtain such metal-containing lubricants. Since the processing of the metal component into powder form is both costly and time consuming, a process which finely divides the metallic component as it is being admixed with the lubricant base is desirable.

STATEMENT OF THE INVENTION

According to the invention, a solid metal is heated until it reaches a liquid state and is then thoroughly admixed into a carrier fluid which is thermally stable at the temperature of the molten metal. It was discovered that the metal disperses into fine globules which are held in suspension without any substantial tendency to coalesce back into larger particles. Furthermore, upon sufficient cooling, the globules harden and remain dispersed in the carrier fluid. The finely divided metal particles are homogeneously dispersed throughout the carrier fluid in the form of spherules of micron and submicron size. When lubricants are used as carrier fluids, the presence of the spherical metal particles causes an increase in the density of the lubricant without any appreciable loss of the lubricating qualities of the lubricant itself.

Furthermore, in accordance with one embodiment of the invention, the discrete spherical metallic particles suspended in the carrier fluid are separated from the carrier fluid by common washing, dissolving or evaporation techniques resulting in a metal powder consisting of the above described metal spherules.

DETAILED DESCRIPTION OF THE INVENTION

The high density metal containing greases of the subject invention can be manufactured from a lubricant base and undivided pieces of metal, such as ingots, for example. Generally, the process includes heating a lubricant and an effective amount of a metal until the metal becomes molten or liquid. The lubricant and metal can be heated separately and then combined, or they can be placed in a single container and heated together. The liquid metal is then thoroughly admixed with the lubricant to form a homogeneous dispersion of finely divided metallic globules within the lubricant. Upon cooling of the mixture, a high density grease is formed which contains finely divided metallic particles. These metallic particles are spherical as opposed to the flake shaped particles which result from ball milling. Furthermore, these particles are microscopic in size generally in the micron and submicron ranges. The metallic particles show no detectable tendency to separate from the lubricant base under the influence of heat, stirring or centrifugation, and the high density metal-containing grease retains substantially all the lubricating properties of the lubricant base component. The grease-like consistency of the metal-containing grease is retained at temperatures both below and above the melting point of the metallic component.

In effect, the lubricant material of the subject invention acts as a carrier fluid for the spherules of metal which are formed upon mixing. The carrier fluid can be comprised of any commonly known lubricating oils or greases or mixtures thereof. The term "lubricant" is used herein to describe preferred types of carrier fluids which are selected from petroleum based lubricants or synthetic lubricants. Petroleum based lubricants, for example, are composed of hydrocarbon substances ranging from low viscosity oils, having molecular weights of about 250, to highly viscous oils having molecular weights of about 1000 or more. The physical properties of petroleum based lubricants depend upon the relative distribution of paraffinic, aromatic, and naphthenic components. Synthetic lubricants include oils having silicone, organic ester, polyglycol, phosphate, polyisobutylene, polyphenyl ether, silicate, chlorinated aromatic or fluorochemical bases. The term "lubricant" is also intended to include greases which are basically composed of either a petroleum or synthetic oil, such as those described above, and a gelling or thickening agent. Common types of gelling agents are the fatty acid soaps of lithium, calcium, sodium, aluminum and barium.

In addition, it should be noted that both detergent and non-detergent types of lubricants can be employed. The spherules of metallic particles are so finely divided that it is unnecessary, in most cases, to use oils having detergent properties in order to keep the spherules in suspension. The sole requirement for a lubricant carrier fluid is that it maintain its integrity at temperatures above the melting point temperature of the metal component being employed. For example, the melting point of tin-silver solder (95% Sn, 5% Ag by weight) is approximately 473° F and the flash point of automotive petroleum based 10W (SAE) motor oil is about 410° F. Therefore, addition of molten tin-silver solder to 10W motor oil would be hazardous and could cause decomposition of the lubricant. Accordingly, silicone based lubricants which have flash points of up to 600° F and higher provide a wider range of possible metal components because of their increased thermal stability.

As long as a sufficiently thermally stable carrier fluid is utilized, it is believed that any normally solid metal can be used in the process of the subject invention. When preparing metal-containing greases in accordance with the subject invention with common types of lubricating materials as carrier fluids, metals having relatively low melting points are preferred. The requirement of the metal component is that it be capable of changing phases from solid to liquid at temperatures which will not cause the lubricant or carrier fluid to decompose. Accordingly, low melting point metals, such as tin, bismuth, cadmium, lead, indium and gallium as well as alloys of these metals, for example, are preferred. Table 1 lists the composition and melting points of some of the preferred alloys which can be employed according to the process of the subject invention.

Table 1

LOW MELTING POINT ALLOYS

| Melting Point ° C | Name | Composition, wt % | | | | |
|---|---|---|---|---|---|---|
| 46.5 | Quinternary Eutectic | Sn 10.65 | Bi 40.63 | Pb 22.11 | In 18.1 | Cd 8.2 |
| 47 | Quinternary Eutectic | Bi 44.7 | Pb 22.6 | Sn 8.3 | Cd 5.3 | In 19.1 |
| 58.2 | Quaternary Eutectic | Bi 49.5 | Pb 17.6 | Sn 11.6 | In 21.3 | |
| 60.5 | | In 51.0 | Bi 32.5 | Sn 16.5 | | |
| 70 | Wood's Metal | Bi 50.0 | Pb 25.0 | Sn 12.5 | Cd 12.5 | |
| 70 | Lipowitz's Metal | Bi 50.0 | Pb 26.7 | Sn 13.3 | Cd 10.0 | |
| 70 | Binary Eutectic | In 67.0 | Bi 33.0 | | | |
| 91.5 | Ternary Eutectic | Bi 51.6 | Pb 40.2 | Cd 8.2 | | |
| 95 | Ternary Eutectic | Bi 52.5 | Pb 32.0 | Sn 15.5 | | |
| 97 | Newton's Metal | Bi 50.0 | Sn 18.8 | Pb 31.2 | | |
| 98 | D'Arcet's Metal | Bi 50.0 | Sn 25.0 | Pb 25.0 | | |
| 100 | Onion's or Lichtenberg's Metal | Bi 50.0 | Sn 20.0 | Pb 30.0 | | |
| 102.5 | Ternary Eutectic | Bi 54.0 | Sn 26.0 | Cd 20.0 | | |
| 109 | Rose's Metal | Bi 50.0 | Pb 28.0 | Sn 22.0 | | |
| 117 | Binary Eutectic | In 52.0 | Sn 48.0 | | | |
| 120 | Binary Eutectec | In 75.0 | Cd 25.0 | | | |
| 123 | Malotte's Metal | Bi 46.1 | Sn 34.2 | Pb 19.7 | | |
| 124 | Binary Eutectic | Bi 55.5 | Pb 44.5 | | | |
| 130 | Ternary Eutectic | Bi 56.0 | Sn 40.0 | Zn 4.0 | | |
| 140 | Binary Eutectic | Bi 58.0 | Sn 42.0 | | | |
| 140 | Binary Eutectic | Bi 60.0 | Cd 40.0 | | | |
| 183 | Eutectic solder | Sn 63.0 | Pb 37.0 | | | |
| 185 | Binary Eutectic | T1 52.0 | Bi 48.0 | | | |
| 192 | Soft solder | Sn 70.0 | Pb 30.0 | | | |
| 198 | Binary Eutectic | Sn 91.0 | Zn 9.0 | | | |
| 199 | Tin foil | Sn 92.0 | Zn 8.0 | | | |
| 199 | White Metal | Sn 92.0 | Sb 8.0 | | | |
| 221 | Binary Eutectic | Sn 96.5 | Ag 3.5 | | | |
| 226 | Matrix | Bi 48.0 | Pb 28.5 | Sn 14.5 | Sb 9.0 | |
| 227 | Binary Eutectic | Sn 99.25 | Cu 0.75 | | | |
| 240 | Antimonial Tin solder | Sn 95.0 | Sb 5.0 | | | |
| 245 | Tin-silver solder | Sn 95.0 | Ag 5.0 | | | |

Where inertness is desired, alloys which do not contain alkali metals are preferred. Furthermore, in addition to the lubricant base and metal component, various additives can be employed. For instance, anti-coalescent additives such as phenylethanolamine, can be used to help stabilize the metallubricant suspension. The addition of paint-grade aluminum has also been found to prevent settling in some cases. Extreme pressure additives can also be included, if desired. Extreme pressure additives include sulfur, tricresyl phosphate and various chlorinated hydrocarbons. These additives are used where extreme rubbing conditions caused by severe metal-to-metal contact would otherwise be encountered.

High density metal-containing greases can be prepared from the above described components in the following manner. The lubricant base and metal components are placed in a suitable container. A heat source is applied to the container until the metal component becomes liquified. Alternatively, the metal component may be heated in a separate container and the liquid metal can then be poured into the container in which the lubricant base was heated. The hot lubricant base and liquid metal are then thoroughly admixed resulting in a homogeneous dispersion of microscopic globules of metal throughout the lubricant base. The mixing can be accomplished by means of common types of mechanical mixers or by sonic methods. The heat source is then removed and the mixture is allowed to cool. The resultant product is a high density metal-containing grease which contains microscopic spherical metallic particles.

In the case of stiffer more viscous greases, low speed mixing is usually sufficient to obtain good dispersion of the liquid metal. When thinner, less viscous lubricants are employed, higher speed mixing may be necessary in order to obtain the complete dispersion of the metal in the lubricant. Finer metallic particles can be produced by forcing the metal-lubricant mixture through small orifices. For example, a mixture can be forced through a needle valve at a temperature above the melting point of the metal component and at a pressure of about 1000 psi.

Unsually high densities are obtainable through use of a high metal to lubricant ratio. In some instances, for example, a weight ratio of 13 parts metal to 1 part lubricant can be employed. The resulting density of the metal containing grease is inversely proportional to the sum of the weight percent of the metal divided by its density plus the weight percent of the lubricant divided by its density. In general, lubricant compositions can be made in accordance with the subject invention that have densities within the range of from about 1 g/ml to about 6 g/ml or more depending upon the types and quantities of the metal and lubricant used.

The above-described process can also be employed to manufacture metal powders. In such case, materials other than lubricants can be used as carrier fluids. For example, where it is desired to comminute a high melting point metal or alloy, molten organic substances or molten salts may provide a stable carrier fluid. Therefore, the term "carrier fluid" as used herein includes lubricants, organic liquids and molten salts. The requirements of the carrier fluid employed are that it be thermally stable at the melting point of the metal being comminuted and that separation of the metal particles from the carrier fluid, by a dissolving or evaporation process, for example, can be accomplished. The metal powder formed by the separation of the metal particles from the carrier fluid is comprised of discrete substantially spherical particles of microscopic size.

The above noted separation methods can also be used when the desired lubricant carrier fluid is thermally unstable at the melting point temperature of the desired metal component. In such cases, the spherical metallic particles can be produced by employing the above process using a carrier fluid which is thermally stable at the melting point temperature of the metal component. Then, the metallic particles can be separated from the thermally stable lubricant carrier fluid to form a metal powder. This metal powder can then be admixed with the desired thermally unstable lubricant carrier fluid to form the desired high density metal-containing grease.

Therefore, it is recognized, and will be apparent to those skilled in the art from reading this specification, that the metal dispersions of this invention are useful in applications other than the lubricating field. For example, this process can be employed to produce metal-organic and metal-inorganic emulsions for use, for instance, in the production of metallized plastics.

EXAMPLES

The following examples are presented to further enable one of ordinary skill in the art to reproduce the present invention. In addition, they set out preferred modes of carrying out the subject invention, and they are not intended in any manner to be delimitative of the invention, but are intended only as examplary.

EXAMPLE 1

Nine parts of Wood's metal (50% bismuth, 25% lead, 12.5% tin, and 12.5% cadmium by weight) and one part of a silicone based grease sold under the trade designation of Dow Corning #111 by Dow Corning, Midland, Michigan, were deposited in a suitable container. The container was positioned on a hot plate and heated until the contents reached 80° to 100° C. The Wood's metal, which has a melting point of 70° C, became molten. The metal and grease were then thoroughly admixed using a blender type mechanical mixer. The liquid metal vanished into and was seemingly enveloped by the silicone grease. The resulting suspension contained discrete spherules of Wood's metal and did not display any tendency to precipitate. The average size of the discrete metal spherules was less than about 2 microns. The metal containing grease was then cooled and the resultant density was determined to be about 5 g/ml.

EXAMPLE 2

Nine parts of Wood's metal and one part of a silicone based grease sold under the trade designation Dow Corning #41 by Dow Corning, Midland, Michigan, were placed in a suitable container. The container was heated until the contents reached approximately 80° to 100° C at which point the Wood's metal became molten. Upon thoroughly admixing the contents, the surprising phenomena of Example 1 occurred, that is, the liquid metal appeared to disappear into the grease carrier fluid. The resulting average particle size of the metal globules was less than one micron. Upon cooling, the resulting metal-containing grease displayed a density of approximately 5 g/ml.

EXAMPLE 3

The procedure of Example 1 was repeated substituting a hydrocarbon based grease sold under the trade designation of Micro Lube by Micro Lube Inc., Dallas, Texas, for silicone grease. The petroleum based grease completely enveloped the liquid metal and the suspension appeared to be substantially stable. This experiment demonstrated that the unexpected acceptance of a molten metal once admixed with a lubricant carrier fluid, does not depend upon synthetic lubricant bases but occurs readily when petroleum based carrier fluids are employed. The resulting metal-containing grease had a density of approximately 5 g/ml.

EXAMPLE 4

An alloy containing 54 parts bismuth, 26 parts tin, and 20 parts cadmium by weight was combined with Dow Corning #111 sold by Dow Corning, Midland, Michigan. The metal to grease weight ratio was approximately 9 to 1. The procedure of Example 1 was followed and the density of the resulting metal-containing grease was approximately 5 g/ml. This alloy, when thoroughly admixed into the lubricant carrier fluid divided into discrete globules having an average particle size less than 1 micron. The metal-containing grease did not demonstrate any observable tendency to precipitate the metal spherules out of suspension upon cooling.

EXAMPLE 5

Equal parts of Wood's metal and a silicone based lubricant sold under the trade name of Dow Corning #103 by Dow Corning, Midland, Michigan, were placed in a container and heated to about 100° C. The Wood's metal became molten and was thoroughly admixed into the lubricant phase until a homogeneous dispersion resulted. The discrete metal spherules formed were of such small particle size that the liquid metal appeared to disappear into the lubricant and, upon cooling, could not be observed to be separating from the lubricant. The final density of the metal-containing grease was about 1.8 g/ml. The consistency of the final mixture was substantially the same as the consistency of the lubricant base itself.

EXAMPLE 6

The procedure of Example 5 was repeated substituting a silicone based grease sold under the trade name of Dow Dorning 44 by Dow Corning, Midland, Michigan, for Dow Corning 103 lubricant. The density of the resulting metal-containing lubricant was again approximately 1.8 g/ml. The particles of metal formed were substantially spherical in shape and had an average size less than 1 micron.

EXAMPLE 7

Equal amounts of Wood's metal and a silicone based grease sold under the trade name Dow Corning FS 3451 by Dow Corning, Midland, Michigan, were placed together and heated in a suitable container. After the Wood's metal became molten, the liquid metal and the hot lubricant were thoroughly admixed. The resultant metal-containing grease had a final density of approximately 1.8 g/ml.

EXAMPLE 8

A silicone based lubricant sold under the trade name Dow Corning G-n Paste by Dow Corning, Midland, Michigan, was used as the lubricant base. An equal weight of Wood's metal was combined with this lubricant in the same manner as in the preceding Examples and the resulting density of the metal-containing lubricant was approximately 1.8 g/ml. The unexpected phenomenon of the liquid metal appearing to be completely "absorbed" into the lubricant carrier fluid was again observed. The particle size of the resulting metal spherules was again in the micron and submicron range.

EXAMPLE 9

Equal parts Wood's metal and a silicone based grease sold under the trade designation Dow Corning M-77 Paste by Dow Corning, Midland, Michigan, were combined and heated to approximately 100° C. The lubricant-liquid metal mixture was then admixed thoroughly and allowed to cool. The resulting metal-containing grease had a density of approximately 1.8 g/ml and displayed substantially the same consistency as did the lubricant base before the addition of the metal component.

EXAMPLE 10

A silicone based grease sold under the trade designation Dow Corning #340 by Dow Corning, Midland, Michigan was combined with an equal weight of Wood's metal in the manner described in the previous Examples. The resulting density of this metal containing lubricant was also approximately 1.8 g/ml and the characteristic spherules of metal of micron and submicron size were formed.

EXAMPLE 11

Equal weights of tin and Dow Corning #111 silicone grease sold by Dow Corning, Midland, Michigan, were placed in a suitable container and heated until the tin became molten. The metal was then thoroughly admixed into the grease until a homogeneous dispersion of microscopic spheres of metal resulted. The consistency of the resulting mixture was substantially the same as the consistency of the grease without the metal.

EXAMPLE 12

Equal weights of bismuth and Dow Corning #111 silicone grease sold by Dow Corning, Midland, Michigan were combined together in the same container and heated until the bismuth became molten. The mixture was then admixed thoroughly until a homogeneous dispersion resulted. The consistency of the dispersion was almost the same as the consistency of the grease component alone. The resulting density of the metal-containing grease was about 1.8 g/ml and tiny spherules of tin having an average diameter less than 10 microns were present.

EXAMPLE 13

Equal amounts of Dow Corning #111 silicone grease sold by Dow Corning, Midland, Michigan, and lead were heated until the lead became molten. The molten lead and grease were then admixed thoroughly and the resulting high density metal-containing grease had a consistency similar to that of the grease alone. The resulting density of this lead-containing grease was about 1.8 g/ml.

EXAMPLE 14

Equal portions of cadmium and Dow Corning #111 silicone grease sold by Dow Corning, Midland, Michigan, were placed in a container and heated until the cadmium became molten. Upon mixing, a high density metal-containing grease was formed which had approximately the same consistency as the grease component alone. The cadmium was formed into discrete micron and submicron size spherules which did not display a tendency to separate from the lubricant carrier fluid.

EXAMPLE 15

Thirteen parts of Wood's metal and one part of Dow Corning Valve Seal silicone grease sold by Dow Corning, Midland, Michigan, were placed in a container. The container was placed on a hot plate and heated until the contents reached about 80° to 100° C. The molten Wood's metal was then thoroughly admixed into the silicone grease. The resulting high density, metal containing grease had a density of approximately 6 g/ml. This experiment demonstrates that in some cases exceedingly high metal to carrier fluid ratios may be employed resulting in very high density metal-containing greases.

EXAMPLE 16

Nine parts of Wood's metal (50% bismuth, 25% lead, 12.5% tin, and 12.5% cadmium by weight) and one part of a lubricant additive sold under the trade name STP by STP Corporation, Fort Lauderdale, Florida, were placed in a container and heated until the metal became molten. Upon mixing, the oil additive completely enveloped the liquid metal and resulted in an apparently stable suspension. The resulting metal-containing grease had a density of approximately 5 g/ml.

EXAMPLE 17

The procedures of Example 3 were repeated except that a hydrocarbon based grease sold under the trade name Lubriplate GR 132 by Fiske Brothers Refining Company, Toledo, Ohio, was substituted for Micro Lube and essentially the same results were obtained.

EXAMPLE 18

The procedures of Example 3 were repeated again using a hydrocarbon grease sold under the trade name Lubriplate High Temp, by Fiske Brothers Refining Company, Toledo, Ohio, with Wood's metal. Results similar to those of Example 3 were obtained in that a metal-containing grease having a density of approximately 5 g/ml was obtained.

The utility of the foregoing invention is apparent to those of ordinary skill in the art. Its utility is especially apparent to those who require lubricants of unusually high densities. Use of the high density metal-containing grease produced by the process of this invention will especially aid those in the business of oil well drilling where drilling mud has heretofore caused lubrication problems. Thus, although the foregoing specification has set forth this invention in relation to preferred embodiments, other variations, alterations, and equivalent formulations and compositions will be apparent to those of ordinary skill. The invention is not intended to be limited in any manner by the foregoing description except as defined by the appended claims.

I claim:

1. A method of manufacturing a high density metal-containing lubricant comprising:

a. heating a solid metal and a lubricant fluid which is thermally stable at the melting point of said metal until the metal becomes molten, the lubricant fluid present in an amount effective to maintain a homogeneous dispersion of microspheres of said molten metal;

b. admixing said molten metal with said lubricant fluid to form a homogeneous dispersion of microspheres of said metal within the lubricant fluid; and c. cooling said lubricant fluid containing said molten metal microspheres to thereby solidify said microspheres.

2. The method of claim 1 wherein said lubricant is selected from synthetic and hydrocarbon lubricants which are thermally stable at the temperature of the molten metal.

3. The method of claim 2 wherein said lubricant is a silicone based grease which is thermally stable at the temperature of the molten metal.

4. The method of claim 2 wherein the lubricant is a hydrocarbon base grease which is thermally stable at the temperature of the molten metal.

5. The method of claim 2 wherein the metal is selected from the group consisting of tin, bismuth, cadmium, lead, indium, gallium and alloys containing at least one of said metals.

6. The high density metal containing lubricant formed by the process of claim 5.

7. The method of claim 5 wherein said alloys are selected from the group consisting of Wood's metal (50.0% Bi, 25.0% Pb, 12.5% Sn, 12.5% Cd by weight), Lipowitz's metal (50.0% Bi, 26.7% Pb, 13.3% Sn, 10.0% Cd by weight), a ternary eutectic comprised of 51.6% Bi, 40.2% Pb, 8.2% Cd by weight, a ternary eutectic comprised of 52.5% Bi, 32.0% Pb, 15.5% Sn by weight, Newton's metal (50.0% Bi, 18.8% Sn, 31.2% Pb), D'Arcet's metal (50.0% Bi, 25.0% Sn, 25.0% Pb by weight), Onion's (or Lichtenberg's) metal (50.0% Bi, 20.0% Sn, 30.0% Pb by weight) a ternary eutectic composed of 54.0% Bi, 26.0% Sn, 20.0% Cd by weight, Rose's metal (50.0% Bi, 28.0% Pb, 22.0% Sn by weight), Malotte's metal (46.1% Bi, 34.2% Sn, 19.7% Pb by weight), a binary eutectic composed of 55.5% Bi, 44.5% Pb by weight, a ternary eutectic comprised of 56.0% Bi, 40.0% Sn, and 4.0% Zn by weight, a binary eutectic comprised of 58.0% Bi, and 42.0% Sn by weight, a binary eutectic comprised of 60.0% Bi, and 40.0% Cd by weight, a eutectic solder comprised of 63.0% Sn, and 37.0% Pd by weight, soft solder comprised of 70.0% Sn and 30.0% Pb by weight, a binary eutectic comprised of 91.0% Sn and 9.0% Zn by weight, tin foil (92.0% Sn, 8.0% Zn by weight), white metal (92.0% Sn, 8.0% Sb by weight), a binary eutectic comprised of 96.5% Sn and 3.5% Ag by weight, a matrix comprised of 48.0% Bi, 28.5% Pb, 14.5% Sn, and 9.0% Sb by weight, a binary eutectic comprised of 99.25% Sn and 0.75% Cu by weight, antimonial tin solder (95.0% Sn, 5.0% Sb by weight), tin-silver solder (95.0% Sn, 5.0% Ag by weight), a binary eutectic comprised of 52.0% Tl and 48.0% Bi by weight, a binary eutectic comprised of 75.0% In and 25.0% Cd by weight, a binary eutectic comprised of 52.0% In, and 48.0% Sn by weight, a binary eutectic comprised of 67.0% In and 33.0% Bi by weight, a quinternary eutectic comprised of 44.7% Bi, 22.6% Pb, 8.3% Sn, 5.3% Cd and 19.1% In by weight, a quinternary eutectic comprised of 10.65% Sn, 40.63% Bi, 22.1% Pb, 18.1% In, and 8.2% Cd by weight, a quaternary eutectic comprised of 49.5% Bi, 17.6% Pb, 11.6% Sn and 21.3% In by weight and an alloy comprised of 51.0% In, 32.5% Bi, 16.5% Sn by weight.

8. The high density metal-containing lubricant formed by the process of claim 7.

9. The method of claim 7 wherein the alloy is Wood's metal.

10. The high density metal-containing lubricant formed by the process of claim 9.

11. The method of claim 7 wherein the alloy is a ternary eutectic containing 54 parts bismuth, 26 parts tin and 20 parts cadmium.

12. The high density metal-containing lubricant formed by the process of claim 11.

13. The method of claim 5 wherein the density of the resulting metal-containing lubricant is from about 1.0 grams per milliliter to about 6.0 grams per milliliter.

14. The method of claim 5 wherein the weight ratio of metal to lubricant is up to about 13 to 1.

15. A method of manufacturing high density metal-containing lubricant comprising:

a. heating a solid metal and a carrier fluid which is thermally stable at the melting point of said metal until said metal becomes molten, the carrier fluid present in an amount effective to maintain a homogeneous dispersion of microspheres of said molten metal;

b. admixing said molten metal with said carrier fluid to form a homogeneous dispersion of microspheres of said molten metal within said carrier fluid and then cooling the resulting mixture to solidify said microspheres;

c. separating said carrier fluid from the resulting metal microspheres; and d. admixing said metal microspheres with a lubricant fluid which is thermally unstable at the melting point of said metal until a homogeneous dispersion results.

16. The method of claim 15 wherein the weight ratio of the metal to the thermally unstable lubricant is up to about 13 to 1.

17. The method of claim 15 wherein the density of said high density metal containing lubricant is in the range of from about 1 g/ml to about 6 g/ml.

18. The method of claim 15 wherein the metal is selected from the group consisting of tin, bismuth, cadmium, lead, indium, gallium and alloys of these metals.

19. The high density metal-containing lubricant formed by the process of claim 18.

20. The method of claim 18 wherein said alloys are selected from the group consisting of Wood's metal (50.0% Bi, 25.0% Pb, 12.5% Sn, 12.5% Cd by weight), Lipowitz's metal (50.0% Bi, 26.7% Pb, 13.3% Sn, 10.0% Cd by weight), a ternary eutectic comprised of 51.6% Bi, 40.2% Pb, 8.2% Cd by weight a ternary eutectic comprised of 52.5% Bi, 32.0% Pb, 15.5% Sn by weight Newton's metal (50.0% Bi, 18.8% Sn, 31.2% Pb), D'Arcet's metal (50.0% Bi, 25.0% Sn, 25.0% Pb by weight), Onion's (or Lichtenberg's) metal (50.0% Bi, 20.0% Sn, 30.0% Pb by weight), a ternary eutectic composed of 54.0% Bi, 26.0% Sn, 20.0% Cd by weight, Rose's metal (50.0% Bi, 28.0% Pb, 22.0% Sn by weight), Malotte's metal (46.1% Bi, 34.2% Sn, 19.7% Pb by weight), a binary eutectic composed of 55.5% Bi, 44.5% Pb by weight, a ternary eutectic comprised of 56.0% Bi, 40.0% Sn, and 4.0% Zn by weight, a binary eutectic comprised of 58.0% Bi, and 42.0% Sn by weight, a binary eutectic comprised of 60.0% Bi, and 40.0% Cd by weight, a eutectic solder comprised of 63.0% Sn, and 37.0% Pb by weight, a soft solder comprised of 70.0% Sn and 30.0% Pb by weight, a binary eutectic comprised of 91.0% Sn and 9.0% Zn by weight, tin foil (92.0% Sn, 8.0% Zn by weight), white metal (92.0% Sn, 8.0% Sb by weight), a binary eutectic comprised of 96.5% Sn and 3.5% Ag by weight, a matrix comprised of 48.0% Bi, 28.5% Pb, 14.5% Sn, and 9.0% Sb by weight, a binary eutectic comprised of 99.25% Sn and 0.75% Cu by weight, antimonial tin solder (95.0% Sn, 5.0% Sb by weight), tin-silver solder (95.0% Sn, 5.0% Ag by weight), a binary eutectic comprised of 52.0% Tl and 48.0% Bi by weight, a binary eutectic comprised of 75.0% In and 25.0% Cd by weight, a binary eutectic comprised of 52.0% In, and 48.0% Sn by weight, a binary eutectic comprised of 67.0% In and 22.0% Bi by weight, a quinternary eutectic comprised of 44.7% Bi, 22.6% Pb, 8.3% Sn, 5.3% Cd and 19.1% In by weight, a quinternary eutectic comprised of 10.65% Sn, 40.63% Bi, 22.11% Pb, 18.1% In, and 8.2% Cd by weight, a quaternary eutectic comprised of 49.5% Bi, 17.6% Pb, 11.6% Sn and 21.3% In by weight and an alloy comprised of 51.0% In, 32.5% Bi, 16.5% Sn by weight.

21. The high density metal-containing lubricant formed by the method of claim 20.

22. The method of claim 20 wherein the alloy is Wood's metal.

23. The high density metal-containing lubricant formed by the method of claim 22.

24. The method of claim 20 wherein the alloy is a ternary eutectic containing 54 parts bismuth, 26 parts tin, and 20 parts cadmium.

25. The high density metal-containing lubricant formed by the method of claim 24.

26. The method of claim 18 wherein the density of the resulting metal-containing lubricant is from about 1.0 grams per milliliter to about 6 grams per milliliter.

* * * * *